US008220446B2

(12) United States Patent
Batdorf

(10) Patent No.: US 8,220,446 B2
(45) Date of Patent: Jul. 17, 2012

(54) ARCHERY CAM PRODUCT—SYSTEM THAT HOOKS CAM-TO-CAM

(76) Inventor: Richard Batdorf, Dunlap, TN (US)

( * ) Notice: Subject to any disclaimer, the term of this patent is extended or adjusted under 35 U.S.C. 154(b) by 421 days.

(21) Appl. No.: 12/277,860

(22) Filed: Nov. 25, 2008

(65) Prior Publication Data

US 2009/0288650 A1 Nov. 26, 2009

Related U.S. Application Data

(60) Provisional application No. 61/127,310, filed on May 12, 2008.

(51) Int. Cl.
*F41B 5/10* (2006.01)

(52) U.S. Cl. ..... 124/25.6

(58) Field of Classification Search ..... 124/25.6, 124/88, 900

See application file for complete search history.

(56) References Cited

U.S. PATENT DOCUMENTS

| | | | | | |
|---|---|---|---|---|---|
| 3,990,425 | A | | 11/1976 | Ketchum | |
| 4,300,521 | A | * | 11/1981 | Schmitt | 124/25.6 |
| 4,333,443 | A | | 6/1982 | Roelle | |
| 4,401,097 | A | | 8/1983 | Simonds et al. | |
| 4,440,142 | A | * | 4/1984 | Simonds | 124/25.6 |
| 4,478,203 | A | * | 10/1984 | Hayes | 124/25.6 |
| 4,561,413 | A | * | 12/1985 | Jennings | 124/25.6 |
| 4,926,833 | A | * | 5/1990 | Darlington | 124/23.1 |
| 4,971,020 | A | | 11/1990 | Soderstrom et al. | |
| 5,174,268 | A | * | 12/1992 | Martin et al. | 124/25.6 |
| 5,368,006 | A | | 11/1994 | McPherson | |
| 5,505,185 | A | | 4/1996 | Miller | |
| 5,901,692 | A | * | 5/1999 | Allshouse et al. | 124/23.1 |
| 5,921,227 | A | * | 7/1999 | Allshouse et al. | 124/25.6 |
| 6,082,346 | A | | 7/2000 | Andrews et al. | |
| 6,082,347 | A | | 7/2000 | Darlington | |
| 6,237,582 | B1 | * | 5/2001 | McPherson | 124/25.6 |
| 6,250,293 | B1 | | 6/2001 | Andrews | |
| 6,360,735 | B1 | | 3/2002 | Larson et al. | |
| 6,443,139 | B1 | | 9/2002 | McPherson | |
| 6,446,619 | B1 | * | 9/2002 | McPherson | 124/25.6 |
| 6,688,295 | B1 | | 2/2004 | Miller | |
| 6,691,692 | B1 | | 2/2004 | Adkins | |
| D510,974 | S | | 10/2005 | Gallops, Jr. | |
| 6,990,970 | B1 | * | 1/2006 | Darlington | 124/25.6 |
| 7,082,937 | B1 | * | 8/2006 | Land | 124/25.6 |
| 7,305,979 | B1 | * | 12/2007 | Yehle | 124/25.6 |
| 7,441,555 | B1 | * | 10/2008 | Larson | 124/25.6 |
| 7,997,259 | B2 | * | 8/2011 | Wilson | 124/25.6 |
| 2004/0003806 | A1 | | 1/2004 | Blahnik | |

* cited by examiner

*Primary Examiner* — John Ricci
(74) *Attorney, Agent, or Firm* — Luedeka Neely Group, P.C.

(57) ABSTRACT

A compound archery bow that includes a compound bow frame having a rigid handle section with rearwardly-projecting upper and lower flexible limbs, an upper cam assembly rotatably supported at the free end of the upper flexible limb, and a lower cam assembly rotatably supported at a free end of the lower flexible limb. The upper cam assembly includes an upper bowstring pulley having an upper bowstring let-out track, a first power cord take-up track, and a second power cord let-out track, while the lower cam assembly includes a lower bowstring pulley having a lower bowstring let-out track, a second power cord take-up track, and a first power cord let-out track. The upper and lower bowstring let-out tracks are aligned in a first bowstring plane, while the first power cord take-up and let-out tracks and the second power cord take-up and let-out tracks are aligned in a second power cords plane.

26 Claims, 9 Drawing Sheets

ARCHERY CAM PRODUCT—SYSTEM THAT HOOKS CAM-TO-CAM

RELATED APPLICATIONS

This application claims priority to U.S. Provisional Patent Application No. 61/127,310 filed May 12, 2008 in the United States Patent and Trademark Office, and entitled, "Archery Cam Product—System that Hooks Cam to Cam," which application is incorporated by reference in its entirety herein.

FIELD OF THE INVENTION

The field of the invention relates generally to archery compound bows, and more specifically to the compound bow cam systems which provide a let-off weight mechanical advantage when the bow is pulled into the drawn position.

BACKGROUND OF THE INVENTION AND RELATED ART

Since the advent of compound bows decades ago, numerous variations have been made to the cord, pulley and cam systems to improve the mechanical advantages provided by the compound bows, such as greater arrow velocity and increased let-off weight. It is widely recognized that compound bows can shoot arrows with greater speed and energy for a given draw weight than conventional or recurve bows. Compound bows can be further advantageous by providing for 'let-off', which is the reduction in the force needed to pull back or restrain the bowstring as the shooter completes the draw back of the bowstring prior to releasing the arrow, as indicated by a percentage of the maximum draw weight. In theory, a let-off weight of 85% at the maximum draw length allows the shooter to maintain the bowstring in the fully-drawn position by only applying 15% of the maximum draw weight experienced during earlier portions of the draw pull.

While the compound bow's mechanical components can provide the user with significant advantages during use, these same components can also interact with the user, the environment, or with each other in ways that can introduce inaccuracies into the shooting system. In order for a compound bow to shoot true and straight, for instance, the upper and lower pulleys or cams must be synchronized together to provide a release force that is imparted evenly to both ends of the bowstring. However, normal wear and tear, thermal effects, improper maintenance, etc., can often throw the upper and lower components out of synchronization and alignment.

Likewise, improvements which may otherwise increase the exit velocity of the arrow as it leaves the compound bow may simultaneously torque or twist the cam assemblies mounted to the forked or slotted ends of the limbs, creating additional shooting errors. What is needed is an improved but simplified compound bow cam system which can simultaneously increase arrow speed while reducing the twisting effects on the cam assemblies that reduce accuracy and introduce unwanted noise and vibration.

SUMMARY OF THE INVENTION

In light of the problems and deficiencies inherent in the prior art, the present invention seeks to overcome these by providing an exemplary embodiment of the compound archery bow of the present invention that includes a compound bow frame having a rigid handle section having a rearwardly-projecting upper flexible limb and a rearwardly-projecting lower flexible limb. The archery bow further includes an upper cam assembly rotatably supported at the free end of the upper flexible limb and a lower cam assembly rotatably supported at a free end of the lower flexible limb. The upper cam assembly further comprises an upper bowstring pulley having an upper bowstring let-out means, a first power cord take-up means, and a second power cord let-out means, while the lower cam assembly comprises a lower bowstring pulley having a lower bowstring let-out means, a second power cord take-up means, and a first power cord let-out means. Furthermore, the upper bowstring let-out means and the lower bowstring let-out means are aligned in a first bowstring plane, while the first power cord take-up and let-out means and the second power cord take-up and let-out means are aligned in a common second plane.

In another exemplary embodiment, the archery bow includes a dual-purpose upper cam module comprised of both the first power cord take-up means and the second power cord let-out means, and a dual-purpose lower cam module comprised of both the second power cord take-up means and the first power cord let-out means, such that the dual-purpose upper and lower cam modules attach to the upper and lower bowstring pulleys, respectively, to form a first set of dual-purpose cam modules in the common second plane offset from the bowstring plane. Moreover, each of these dual-purpose cam modules can have a common take-up/let-out journal, so that one power cord is let-out from one point on the take-up/let-out journal as the other power cord is taken-up at another point on the take-up/let-out journal.

In another exemplary embodiment of the archery bow of the present invention, each power cord take-up means comprises a take-up cam module attached to the upper or lower bowstring pulley, respectively; and each power cord let-out means further comprises a separate let-out cam module attached to the upper or lower bowstring pulley, respectively. In an alternative embodiment, each take-up cam module or let-out cam module can be adjustably attached to the upper and lower bowstring pulleys, respectively, to provide adjustment of the draw length, draw weight, and/or let-off weight of the compound bow.

In another exemplary embodiment of the archery bow of the present invention, at least one end of a power cord is coupled to a rotator splitter that is operably connected to a mid-section of a splitter cord having an outside end and an inside end, and where the outside end is coupled to a cam module and the inside end is coupled to the axle of the cam assembly or the free end of the associated limb.

In accordance with the invention as embodied and broadly described herein, the present invention also resides in a cam assembly for a compound archery bow that includes a bowstring pulley having a bowstring let-out journal track comprising a first bowstring plane, and a first power cord take-up means and a second power cord let-out means aligned together in a second common power cord plane.

In one exemplary aspect of the present invention, the first power cord take-up means and the second power cord let-out means can together form a dual-purpose cam module having a common take-up/let-out journal or track, wherein the second power cord is let-out from one point on the take-up/let-out journal as the first power cord is taken-up at another point on the take-up/let-out journal. And in another exemplary aspect of the present invention, the first power cord take-up means and the second power cord let-out means can further include a first take-up cam module and a separate second let-out cam module, respectively, with either or both of the take-up or let-out cam modules being adjustably attached to the bowstring pulley to provide adjustment of the draw length draw weight, and/or let-off weight of the compound bow.

BRIEF DESCRIPTION OF THE DRAWINGS

Features and advantages of the invention will be apparent from the detailed description that follows, and which taken in conjunction with the accompanying drawings, together illustrate features of the invention. It is understood that these drawings merely depict exemplary embodiments of the present invention and are not, therefore, to be considered limiting of its scope. And furthermore, it will be readily appreciated that the components of the present invention, as generally described and illustrated in the figures herein, could be arranged and designed in a wide variety of different configurations. Nonetheless, the invention will be described and explained with additional specificity and detail through the use of the accompanying drawings, in which.

DETAILED DESCRIPTION OF EXEMPLARY EMBODIMENTS

Figure 1:
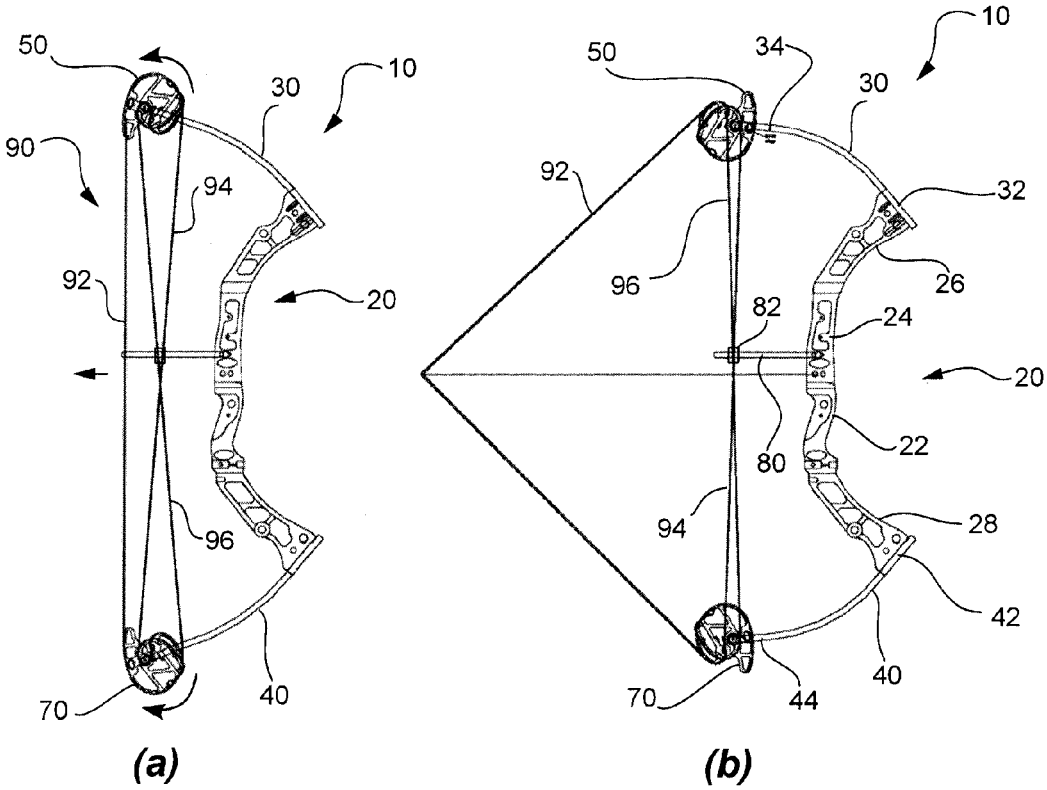
FIGS. 1*a* and 1*b* together illustrate side views of a compound bow in undrawn and drawn positions, respectively, and in accordance with an exemplary embodiment of the present invention.

The following detailed description of the invention makes reference to the accompanying drawings, which form a part thereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention. As such, the following more detailed description of the exemplary embodiments of the present invention is not intended to limit the scope of the invention as it is claimed, but is presented for purposes of illustration only: to describe the features and characteristics of the present invention, and to sufficiently enable one skilled in the art to practice the invention. Accordingly, the scope of the present invention is to be defined solely by the appended claims.

The present invention, as broadly described herein, resides in a compound archery bow system having one or two cam assemblies. A cam assembly generally includes a bowstring pulley with a main let-out track for the bowstring cable, and one or more cam modules or 'mods' attached to a side of the bowstring pulley for connection with at least two power cord cables. The entire cam assembly can be mounted on a rotatable axle which is supported at both ends by the free end of a flexible limb, while the frame end of the flexible limb can be coupled to a frame section.

The side-mounted cam modules can be configured to simultaneously provide take-up for one of the power cords and let-out for the other as the cam assembly rotates around a horizontal pivot point or axle. If two power cord cam modules are used, both the take-up 'mod' and the let-out 'mod' can be attached to the same side of the pulley cable, with the take-up track or journal in the take-up module being aligned in the same plane as the let-out track or journal in the let-out module. The common plane for both cam modules can be aligned adjacent to and parallel with the plane of the bowstring pulley, resulting in a two-plane system. Limiting the number of planes to two, and minimizing the distance between the two planes can function to reduce the twisting forces acting on the other components in the archery bow system, thereby improving accuracy and performance.

Unlike the prior art, in which the bowstring, take-up, and let-out pulleys are axially separated into three different planes, the present invention allows for the two power cords to be substantially aligned in the same plane, which acts to combine the vertical loads acting on the cam assembly into a power cord plane and the bowstring plane. It has been discovered that it is easier and more effective to balance the loads acting on the cam assembly when the forces are limited to two planes, rather than spread out over three or more planes. This is because the central balancing point is easier to locate and utilize by suspending the geometric center of the cam assembly between the two load planes. This configuration can act to equalize the opposing moments generated by the tensile forces acting within the two planes, and can also be less sensitive to the minor variations in cable loading which are inevitable with the 3-cord system used in most compound bows. Consequently, a properly-balanced cam assembly is less prone to twisting and lean errors and the subsequent inaccuracies in shooting performance.

A cam assembly having the two-plane configuration described above can be further beneficial by allowing for one or both of the cam modules to be interchangeable or adjustable, which can alter both the draw length and the draw weight profile. It can be appreciated that each user of a compound bow will have individualized dimensions for their torso, shoulders, arms, neck, head, etc., which results in their own unique musculature and skeletal configuration. The ease-of-use and comfort level of the user will be increased if the bow system can be tailored to their specific needs, such as with an increased draw length, modified draw weight profile, reduced let-off weight or an extended hard stop position, etc.

In one aspect of the present invention, one of the cam modules, such as the take-up module, can be interchangeable with a plurality of take-up modules, each having a different size or which can located in a different orientation. Changing the shape or orientation of the take-up journal relative to the pivot point of the cam and the bowstring track can significantly alter the mechanical leverage provided by the cam module. In another aspect of the invention, the position of one of the cam modules, such as the take-up module, can be altered in small increments to allow adjustment of the draw length or draw weight profile in pre-defined increments. Further adjustability can be provided for by allowing both the take-up module and let-out modules to have round, eccentric or non-circular shapes or profiles.

In another embodiment of the present invention, the separate take-up and let-out modules can be combined into one dual-purpose cam module that performs both functions. The dual-purpose cam module can be configured with a common take-up/let-out journal or track, in which one power cord is let-out from one point on the take-up/let-out journal as the other power cord is simultaneously taken-up at another point on the take-up/let-out journal. It can be appreciated by one having skill in the art that a single dual-purpose cam module mounted to the side of a rotatable bowstring pulley is a significant improvement that can reduce the material and manufacturing costs associated with more conventional cam assemblies. The elegant simplicity of a two-plane/two-track system that provides connection and operating surfaces for all three cables, namely the bowstring and the two power cords, can further reduce fabrication and assembly errors and can improve long-term reliability and performance.

The cam assembly described above can be used with both single-cam and dual- or twin-cam compound bows. When used in a single-cam configuration, the end of the bowstring opposite the cam assembly can be attached to an idler pulley mounted to the opposite flexible limb, and the ends of the power cords opposite the cam assembly can be mounted to their own idler pulley or pulleys, or directly to the opposite limb. Moreover, in a single-cam configuration the cam assembly can be mounted to either of the upper or lower limbs.

In the dual- or twin-cam configuration, the shape and placement of a cam module on the upper cam assembly can be a mirror image of the shape and placement of a corresponding cam module on the lower cam assembly, resulting a symmetric dual-cam configuration. The symmetric arrangement can provide for simplicity in design and reduced costs in manufacturing and assembly. In another aspect of the present invention, however, the dual-cam configuration can be non-symmetric, which allows for increased flexibility and adjustability in optimizing the performance of the bow system to meet the unique requirements of a specific user.

In another aspect of the dual-cam design of the present invention, a shoot-through configuration can be provided for by attaching a second set of take-up modules and let-out modules to each of the upper and lower bowstring pulleys, on the opposite side from the first set of the take-up modules and let-out modules. The second set of take-up modules and let-out modules can be formed in a common third vertical plane. With this configuration, the compound bow system can become a five cable system having a center bowstring and two sets of the power cords, one to each side of the bowstring cable. In a variation of this configuration, the take-up modules and let-out modules on each side of both the upper and lower bowstring pulleys can be combined into dual-purpose cam modules having a common take-up/let-out journal or track.

In addition to consolidating the take-up and let-out tracks into a single vertical plane, the present invention can be further advantageous by providing for a rotator splitter which can be used to finely balance the loads applied to the cam assemblies and limbs of the compound bow system. The rotator splitter acts to sub-divide the loads applied by a single power cord and distribute it over two pre-defined locations. Proper selection of the pre-defined locations can act to further reduce the torsional loading which can twist and bend the limbs of the bow during use.

The rotator splitter can be used with either or both of the take-up or let-out ends of a power cord. One end of the rotator splitter can be coupled to the power cord, while the other end can include a splitter roller that is captured around the mid-span of a splitter cord. The two ends of the splitter cord can be coupled to the power cam modules or directly to the flexible limb to better distribute the tensile forces applied by the power cord. Providing the splitter roller with an internal bearing, moreover, ensures that loads applied at both locations are always equal In one aspect of the invention, one end of the splitter cord can be attached to the limb or one end of the axle of the cam assembly while the other end is coupled to a single-purpose or dual-purpose cam module coupled to the opposite side of the bowstring pulley. In another aspect, the ends of the splitter cord can be coupled to dual-purpose cam modules attached to both sides of the bowstring pulley.

Each of the above-recited advantages will be apparent in light of the detailed description set forth below and best understood with reference to the accompanying drawings, wherein the elements and features of the invention are designated by numerals throughout. These advantages are not meant to be limiting in any way. Indeed, one skilled in the art will appreciate that other advantages may be realized, other than those specifically recited herein, upon practicing the present invention.

With reference to FIGS. 1*a* and 1*b* and in accordance with an exemplary embodiment of the present invention, illustrated is a dual- or twin-cam compound archery bow 10 in undrawn and drawn positions. The bow can comprise a rigid, central frame 20 having a handle section 22, a guide section 24, and upper riser section 26, and a lower riser section 28. The archery bow can also include an upper flexible limb 30 having a fixed end 32 coupled to the frame section and a free end 34 extended backwards towards the body of the user. The archery bow can further included a lower flexible limb 40 that also has a fixed end 42 and a free end 44. The free ends 34, 44 of both the upper and lower flexible limbs can have a slotted or forked configuration for providing a gap in which a cam assembly can be rotatably supported. For example, an upper cam assembly 50 and a lower cam assembly 70 can be mounted and rotatably supported on axles straddling the gaps in the free ends of the upper and lower flexible limbs 30, 40.

The upper and lower cam assemblies 50, 70 can be connected with at least three cables, specifically the drawstring 92, a first power cord 94 and a second power cord 96. Additional power cords can be added between the first and second cam assemblies if needed or desired to alter the mechanical characteristics of the compound bow. As will be discussed in more detail below, both the upper and lower cam assemblies and their connecting drawstring and power cables can be associated together into a cam assembly sub-system 90 of the compound archery bow 10 that can embody a number of features and improvements over the prior art.

The compound archery bow 10 can also include a guide rod 80 that projects rearward from the guide section 24 of the central frame 20 for slidably supporting a slide harness 82 for the power cords. The first and second power cords 94, 96 can slidably pass through notches or slots in the harness near the mid-span of the cords. The harness functions to keep the two power cords from contacting and rubbing against each other as the drawstring is drawn backwards and released. It can be appreciated that while the journals or tracks of the power cord cam modules will align together in a common plane, as described below, the guide rod and slide harness can act to pull the power cords themselves to one side of the bowstring at the center span of the compound bow, so as to provide more lateral clearance to shoot the arrow.

Operation of the compound archery bow 10, as illustrated in the differences between FIG. 1*a* and FIG. 1*b*, can be easily appreciated. Drawing back on the drawstring 92 with one hand while firmly supporting the rigid frame 20 at the handle section 22 causes the upper cam assembly 50 to rotate counter-clockwise and the lower cam assembly 70 to rotate clockwise, to symmetrically let-out the drawstring from the backsides of both cam assemblies. Rotating both cam assemblies in the above fashion simultaneously causes the power cords 94, 96 to be taken up on the front side of the cam assemblies, which action shortens the distance between the cam assemblies and bends the free ends 32, 42 of the flexible limbs 30, 40 inward towards each other. This bending creates the reaction force which will shoot the arrow forward after the drawstring is released.

Pulling the limbs 30, 40 inward also causes the entire cam assembly sub-system 90, including the power cords 94, 96, to move rearward a proportional distance. The slide harness 82 can slide backward and forwards with the power cords along the guide rod 80 to maintain the separation between the two power cords throughout the entire draw and release cycle.

It is to be appreciated that the radial profiles of the cam assemblies 50, 70, the comparative lengths of the drawstring 92 and power cords 94,96, and the stiffness (or flexibility) of the limbs 30, 40 can be configured together form a complete compound archery bow system 10 with the desired operating characteristics.

Figure 2:
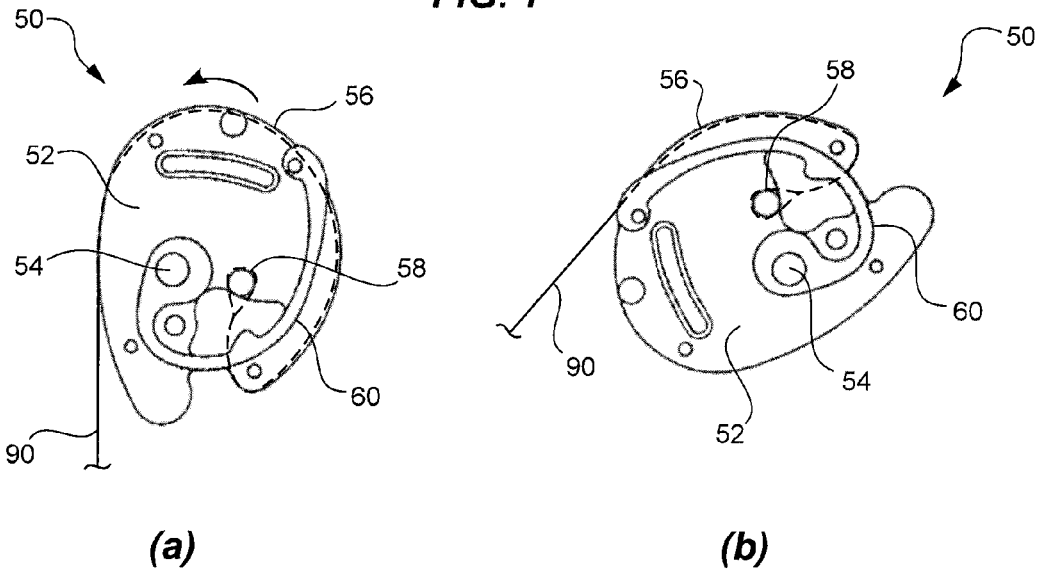
FIGS. 2*a* and 2*b* together illustrate close-up side views of the upper cam assembly in undrawn and drawn positions, respectively, and in accordance with the embodiment of FIG. 1.

For illustrative purposes, the upper cam assembly 50 is shown in more detail in FIGS. 2*a* and 2*b* without the two attached power cords. The upper cam assembly can comprise a bowstring pulley 52 to which a power cords cam module 60, or 'power mod', has been attached. As will be discussed in more detail below, in the embodiment 50 of the present invention the power mod 60 is a dual-purpose power cords module which can simultaneously provide for both the power cord let-out and take-out operations of the upper cam assembly 50. The upper cam assembly 50 can be supported on an axle or axis 54, about which both the cam assembly, including both the bowstring pulley 52 and the attached power cords module 60, can rotate. The figures illustrate the position of the upper cam assembly in the undrawn position (FIG. 2*a*), and in the drawn position after the upper cam assembly has been rotated counter-clockwise between about 110 and 130 degrees (FIG. 2*b*).

The bowstring pulley can be a substantially flat or planar cam body that is bounded on the edges by an outer bowstring journal 56 or track which holds and supports the bowstring. The bowstring pulley 52 can be round, eccentric, or non-circular, as shown in the exemplary cam assembly embodiment 50. Given that the bowstring 92 will be in constant tension once the compound bow has been assembled, the bowstring can be pulled tight into the track as it is wrapped around the outer journal 56 to attach at the bowstring anchor or hook 58. One can also see from FIGS. 2*a* and 2*b* that drawing back on the bowstring 92 can cause the bowstring to release or "let-out" from the bowstring journal as the upper cam assembly 50 rotates counter-clockwise.

The bowstring pulley can also include a slot 59 for an adjustable rotation stop that can function to prevent the cam assembly from over-rotating when pulled back into the drawn position.

Figure 3:
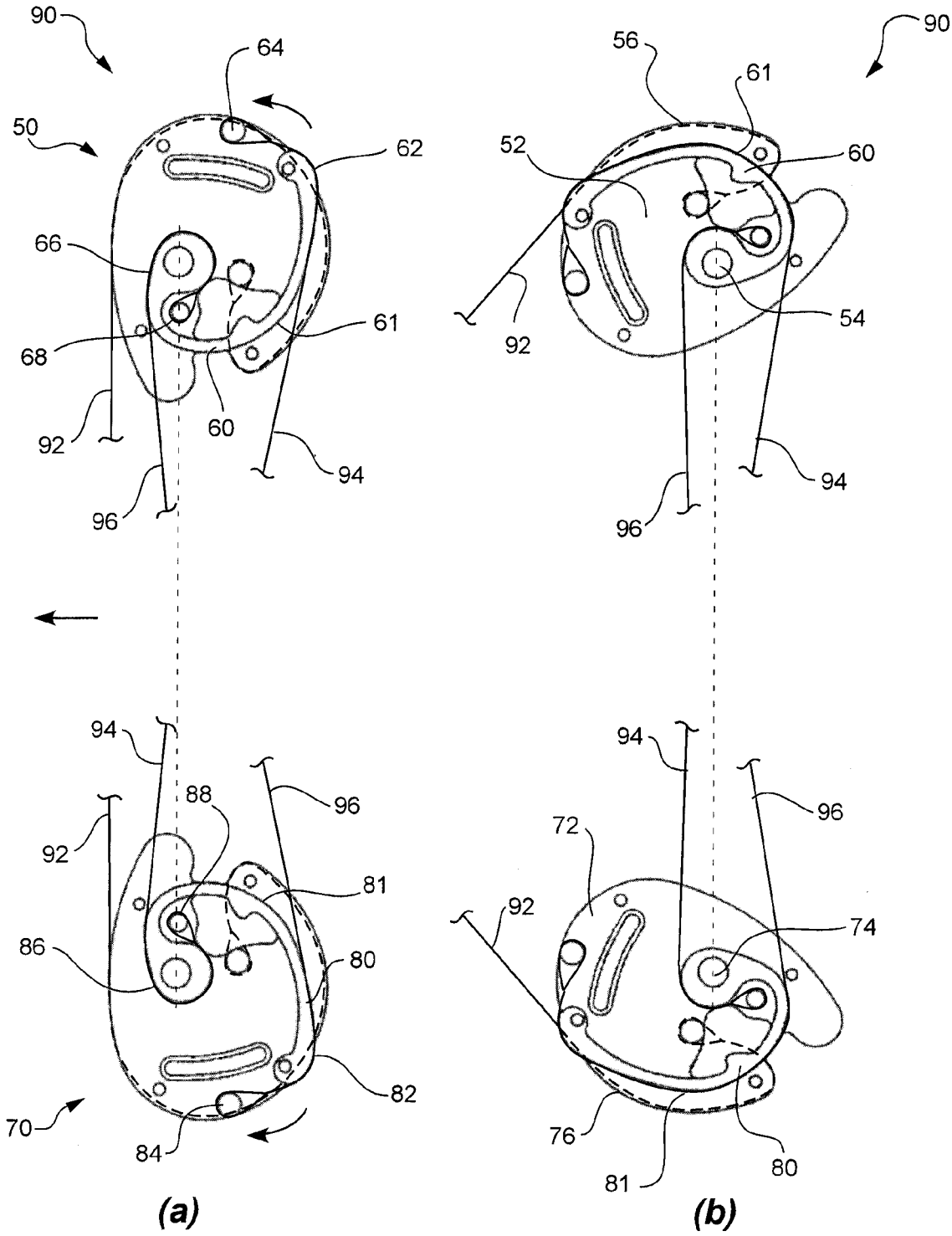
FIGS. 3*a* and 3*b* together illustrate side views of the upper and lower cam assemblies in undrawn and drawn positions, respectively, and in accordance with the embodiment of FIG. 2.

The entire cam assembly sub-system 90, including the upper cam assembly 50, the lower cam assembly 70, the bowstring 92, the first power cord 94 and second power cord 96, is shown in FIGS. 3*a* and 3*b*. As before, FIG. 3*a* shows the cams in the undrawn position, while FIG. 3*b* shows the cams in the drawn position, after the upper cam assembly has been rotated counter-clockwise about axis 54 between about 110 and 130 degrees, and the lower cam assembly has been rotated clockwise about axis 74 between about 110 and 130 degrees.

Looking first at the upper cam assembly 50, the upper power cords module 60 is a dual-purpose module having both a power cord take-up end 62 and a power cord let-out end 66 on the same body 60. In other words, the power cord take-up and let-out functions can be combined into the same journal 61 (e.g. track or groove), with an upper end of the first power cord 94 being attached or looped around anchor point or hook 64 and being taken-up at one end 62 of the journal, simultaneous with an upper end of the second power cord 96 being attached or looped around anchor point or hook 68 and being let-out at the other end 66 of the journal.

Thus, in the upper cam assembly 50 of the present invention the bowstring let-out journal 56, the second power cord let-out 66, and the first power cord take-up 62 functions can be provided for with only two tracks or journals, the bowstring pulley journal 56 and the dual-purpose power cords cam module journal 61, resulting in the two-plane/two-track embodiment of the present invention.

This configuration is advantageous over the prior art, which has axially-separable cam bodies or modules for the power cord take-up and let-out functions, leading to a three-body/three-plane/three-track cam assembly when the separate power cord take-up and let-out cam bodies are assembled with the bowstring pulley into a upper (or lower) cam assembly. As a result, comparable cam assemblies disclosed in the prior art have three or more power cord and bowstring journals aligned in three or more separate planes. This creates non-trivial complications when balancing the loads about the cam assembly's axis of rotation, as optimally all three load-bearing cords and their laterally-applied moments should be balanced in order to avoid twisting or torquing the cam assembly about the free end of its supporting flexible limb.

In contrast to the prior art, the present invention allows for the two power cords to be aligned in the same plane, effectively combining the vertical loads acting on the cam assembly into a power cord plane and a bowstring plane. It is easier and more effective to balance the loads acting on the cam assembly when the forces are limited to two planes, rather than spread out over three or more planes, because the central balancing point is easier to locate and position when the geometric center of the cam assembly is suspended between the two load planes. This configuration can better equalize the opposing moments generated by the tensile forces created by the bowstring and power cords, while at the same time becoming less sensitive to the minor variations in cable loading which are inevitable with the 3-cord system used in many compound bows. Consequently, a properly-balanced cam assembly with just two planes is less prone to twisting and lean errors during operation and the resulting inaccuracies in shooting performance.

Referring back to FIGS. 3*a* and 3*b*, the lower cam assembly 70 can be a mirror image of the upper cam assembly, having a bowstring pulley 72 with a bowstring let-out journal (or means) 76 and a lower dual-purpose power cords module 80 affixed to the side of the cam body 72. The lower end of the first power cord 94 can be attached or looped around an anchor point 88 and let-out at one end 86 of the lower journal 81. Likewise, the lower end of the second power cord 96 can be attached or looped around anchor point or hook 84 and taken-up at the opposite end 82 of the journal 81.

Thus, drawing back on the bowstring to operate the compound bow causes both the upper and lower cam assemblies 50, 70 to rotate towards each other as the bowstring is simultaneously let-out from the upper bowstring pulley let-out journal (or means) 56 and the lower bowstring pulley let-out journal (or means) 76. At the same time, the rotation of the upper and lower cam assemblies causes the first power cord 94 to be simultaneously taken-up by the take-up end (or means) 62 of the upper power cords module 60 as it let-out at the let-out end (or means) 86 of the lower power cords module. Likewise, the rotation of the upper and lower cam assemblies causes the second power cord 96 to be simultaneously taken-up by the take-up end (or means) 82 of the lower power cords module 80 as it let-out at the let-out end (or means) 66 of the upper power cords module 60.

Since the take-up ends are located at a greater distance (e.g. radius) from the axis of rotation 54, 74 than let-out ends for both the upper and lower power cords modules, more of each power cord 94, 96 is taken-up than is let-out during the drawing of the compound bow. This effectively shortens the length of the power cords and draws the two flexible limbs together, placing them more in tension and generating potential energy that will be used to shoot the arrow upon release.

It is to be appreciated that the shape of the upper and lower power cam modules be round, eccentric, or as in the case of the power cords modules 60, 80 of the present invention illustrated in FIGS. 1-3*b*, non-round. Indeed, a variety of dual-purpose power cords cam modules, each with different shapes, sizes and orientations relative to the bowstring pulley, can all be considered to fall within the scope of the present invention. This is because the shape, size and orientation of the cam modules are factors which can act to vary the draw length, draw weight and/or let-off weight of the compound bow.

It is also to be appreciated that the dual-purpose power cords cam modules 60, 80 can be mirror images of each other, provided dynamic action that is symmetric about both cam assemblies during the drawing and release stages of the shooting cycle. This ensures that the upper and lower pulleys or cams are synchronized together and provides a release force that is imparted evenly to both ends of the bowstring, and which in turn leads to improved the accuracy of the bow.

Figure 4:
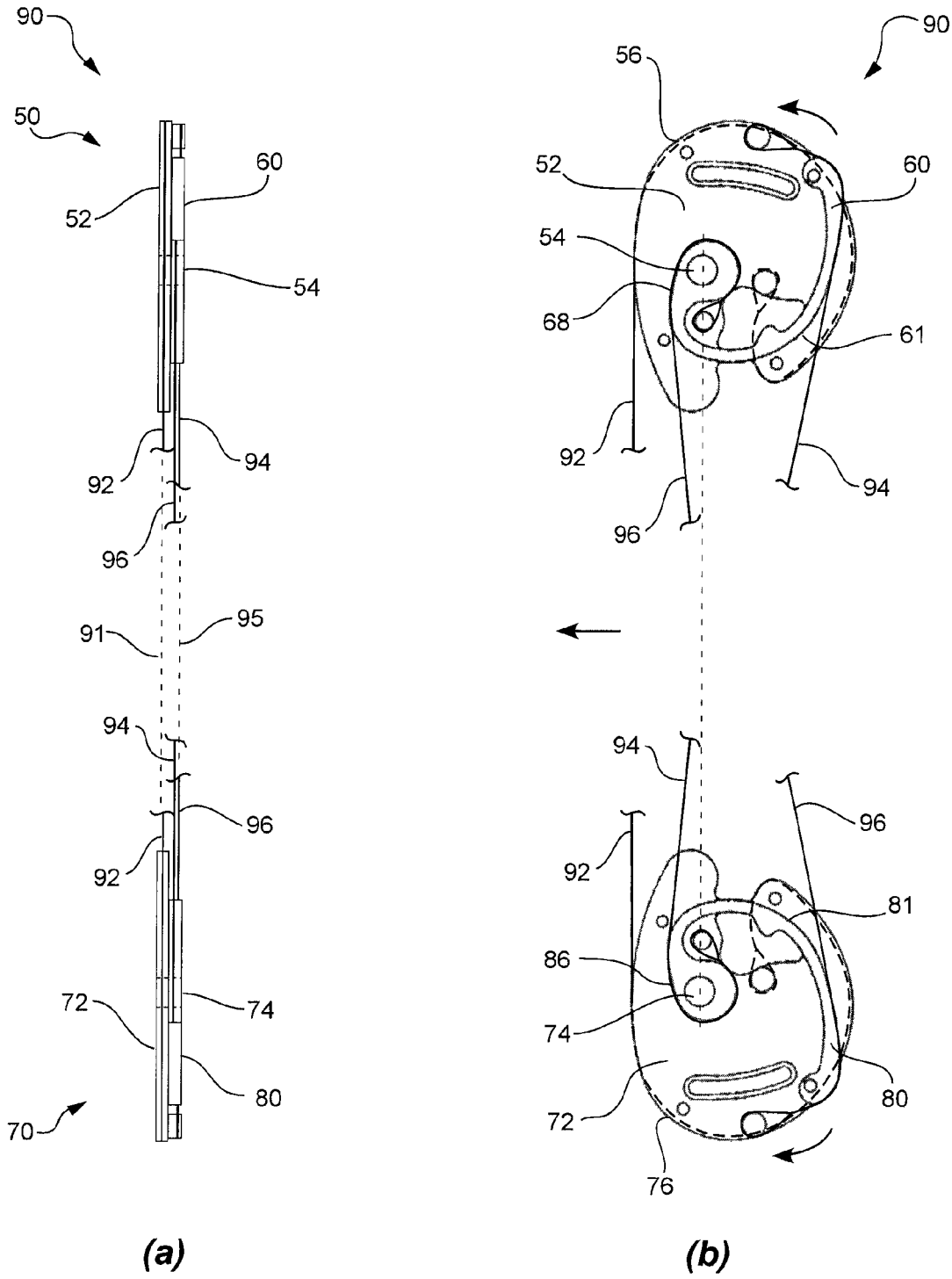
FIGS. 4*a* and 4*b* together illustrate back and side views, respectively, of the upper and lower cam assemblies in an undrawn position, and in accordance with the embodiment of FIG. 2.

FIGS. 4*a* and 4*b* include a back view of cam assembly sub-system 90 as viewed by the user holding the bow, with the compound bow in the undrawn position. This view serves to illustrate the two-plane aspect of the present invention, in which the vertical loads from bowstring 92 and the two power cords 94, 96 are combined within the cam assembly into a bowstring plane 91 and a power cord plane 95. Moreover, the view also illustrates that the bowstring pulleys 52, 72 and dual-purpose power cords cam modules 60, 80 combine to form cam assemblies 50, 70, with each cam assembly having only two tracks or journals (56, 61 and 76, 81) formed in the outer edge surfaces for retaining the bowstring 92 and power cords 94, 96.

It can be appreciated by one of skill in the art that the two-plane/two-track cam assemblies (e.g. the two-track system) of the present invention is a significant improvement that can reduce the material and manufacturing costs associated with more conventional multi-body cam assemblies. The elegant simplicity of a two-track system that provides connection and operating surfaces for all three cables, specifically the bowstring and the two power cords, can further reduce fabrication and assembly errors and can improve long-term reliability and performance.

Both the bowstring pulleys 52, 72 and power cords cam modules 60, 80 can be comprised of substantially planar cam bodies having a defined thickness. The cam modules can be removably attached to the sides of the bowstring pulleys, or can be integrally formed with or permanently affixed to the bowstring pulley. In one aspect of the present invention, the let-out ends 66, 86 of the power cords cam modules 60, 80 can coincide with the axis of rotation 54, 74 of the bowstring pulleys, allowing the combined thickness of the bowstring pulley and the power cords cam module at that location to be used to provide the axial support for the cam assembly. A bearing, such as a sleeve bearing or rolling element bearing, can be installed at the axis of rotation 54, 74 to rotably support the respective cam assembly 50, 70 in the gap at the free end of the flexible limb (see FIGS. 1*a* and 1*b*).

Figure 5:
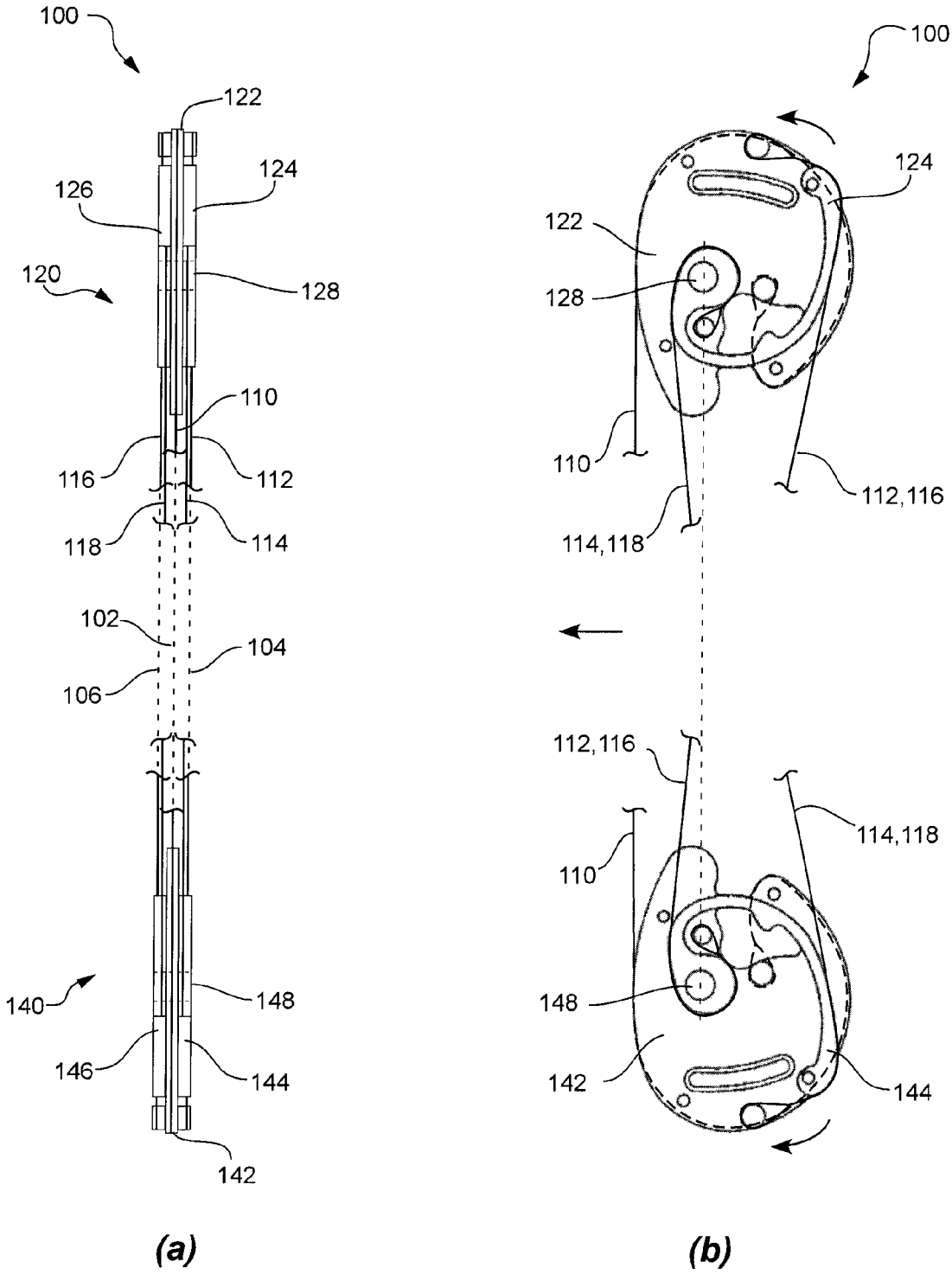
FIGS. 5*a* and 5*b* together illustrate back and side views, respectively, of the upper and lower cam assemblies in an undrawn position, and in accordance with another exemplary embodiment of the present invention.

FIGS. 5*a* and 5*b* illustrate the back and side view of another exemplary embodiment 100 of the cam assembly sub-system of the present invention which comprises a "shoot-through" configuration. In this embodiment, a dual-purpose power cords cam module 124, 126 can be attached to both sides of the bowstring pulley 122 to form the upper cam assembly 120. Likewise, dual-purpose power cords cam modules 144, 146 can be attached to both sides of the bowstring pulley 142 to form the lower cam assembly 140. In addition to the central bowstring 110, the cam assembly sub-system can include a set of first and second power cords 112, 114 on the right-hand side of the cam assembly sub-system (as viewed from the back), as well as a set of first and second power cords 116, 118 on the left. This also changes the two-plane/two-track system to a three-plane/three-track system having a bowstring plane 102, a right-hand power cords plane 104 and left-hand power cords plane 106.

Placing a second set of power cords and dual-purpose power cords cam modules on the left-hand sides of the upper and lower bowstring pulleys can function to increase the effective draw weight of the compound bow, with a corresponding increase in the exit velocity of the arrow. If the second set of power cords and dual-purpose power cords cam modules mirrors the first set, the three-plane system can also be symmetrically balanced across the axis of rotation 128, 148 of each cam assembly 120, 140. With the bowstring located between the two sets power cords, the arrow can be drawn back and shot through the two sets of power cords to form the "shoot-through" configuration.

FIGS. 6*a*, 6*b* and 7*a*, 7*b* together illustrate another exemplary embodiment 200 of the dual- or twin-cam sub-system of the present invention, in which each power cord take-up means comprises a take-up cam module attached to the upper or lower bowstring pulley, respectively, and each power cord let-out means further comprises a separate let-out cam module that is also attached to the upper or lower bowstring pulley, respectively.

Figure 6:
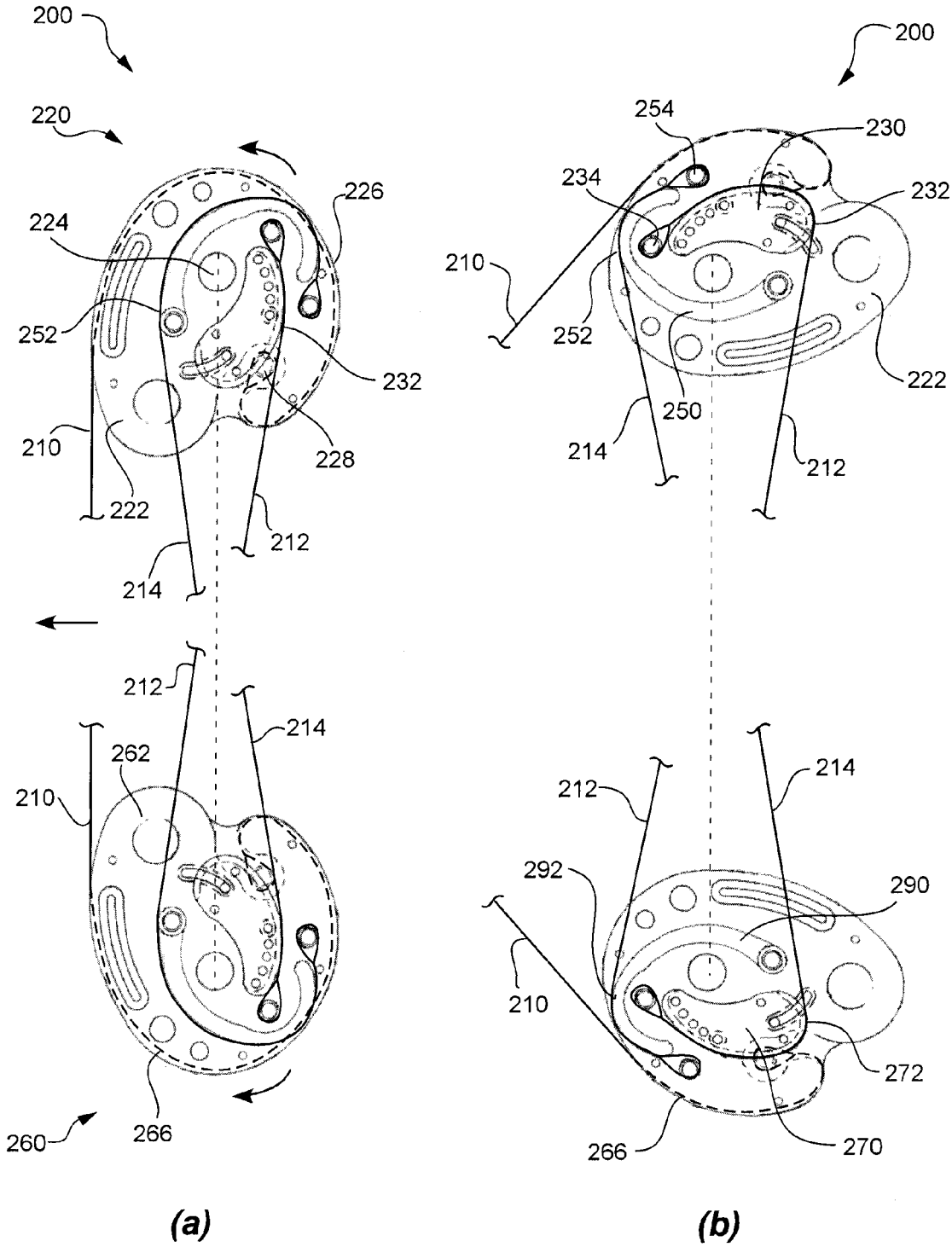
FIGS. 6*a* and 6*b* together illustrate side views of the upper and lower cam assemblies in undrawn and drawn positions, respectfully, and in accordance with yet another exemplary embodiment of the present invention.
Figure 7:
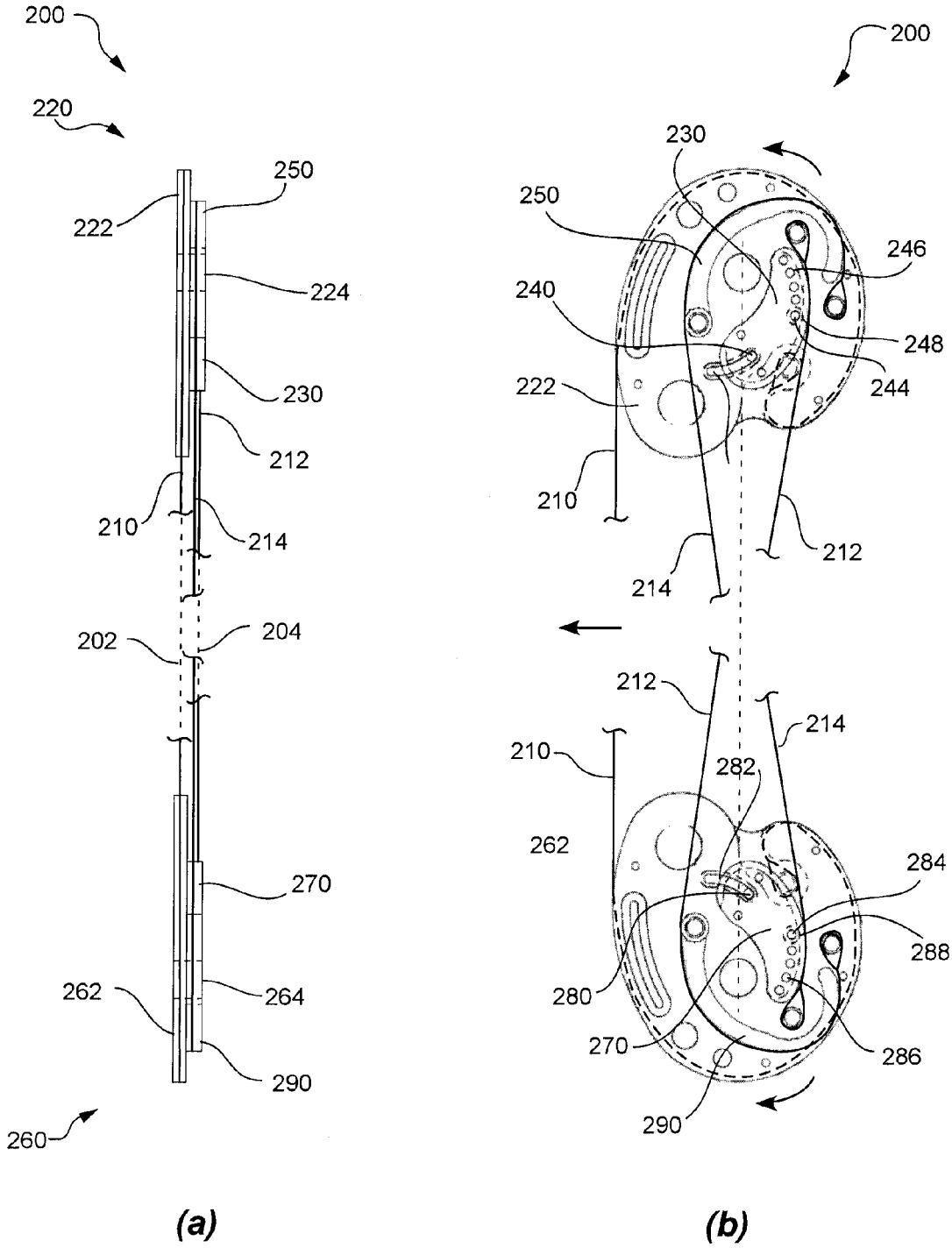
FIGS. 7*a* and 7*b* together illustrate back and side views, respectively, of the upper and lower cam assemblies in an undrawn position, and in accordance with the embodiment of FIG. 6.
Figure 8:
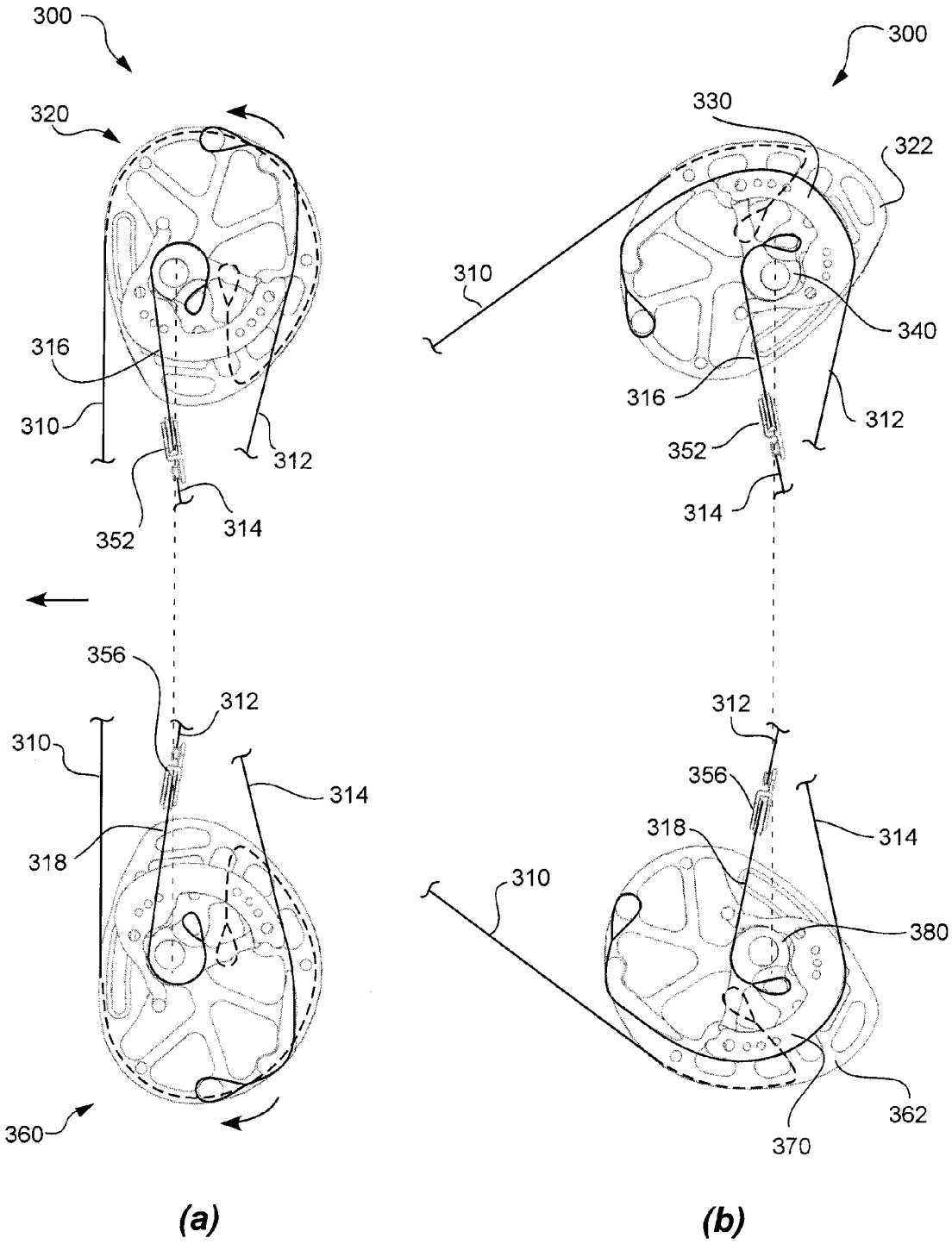
FIGS. 8*a* and 8*b* together illustrate side views of the upper and lower cam assemblies in undrawn and drawn positions, respectfully, and in accordance with yet another exemplary embodiment of the present invention.
Figure 9:
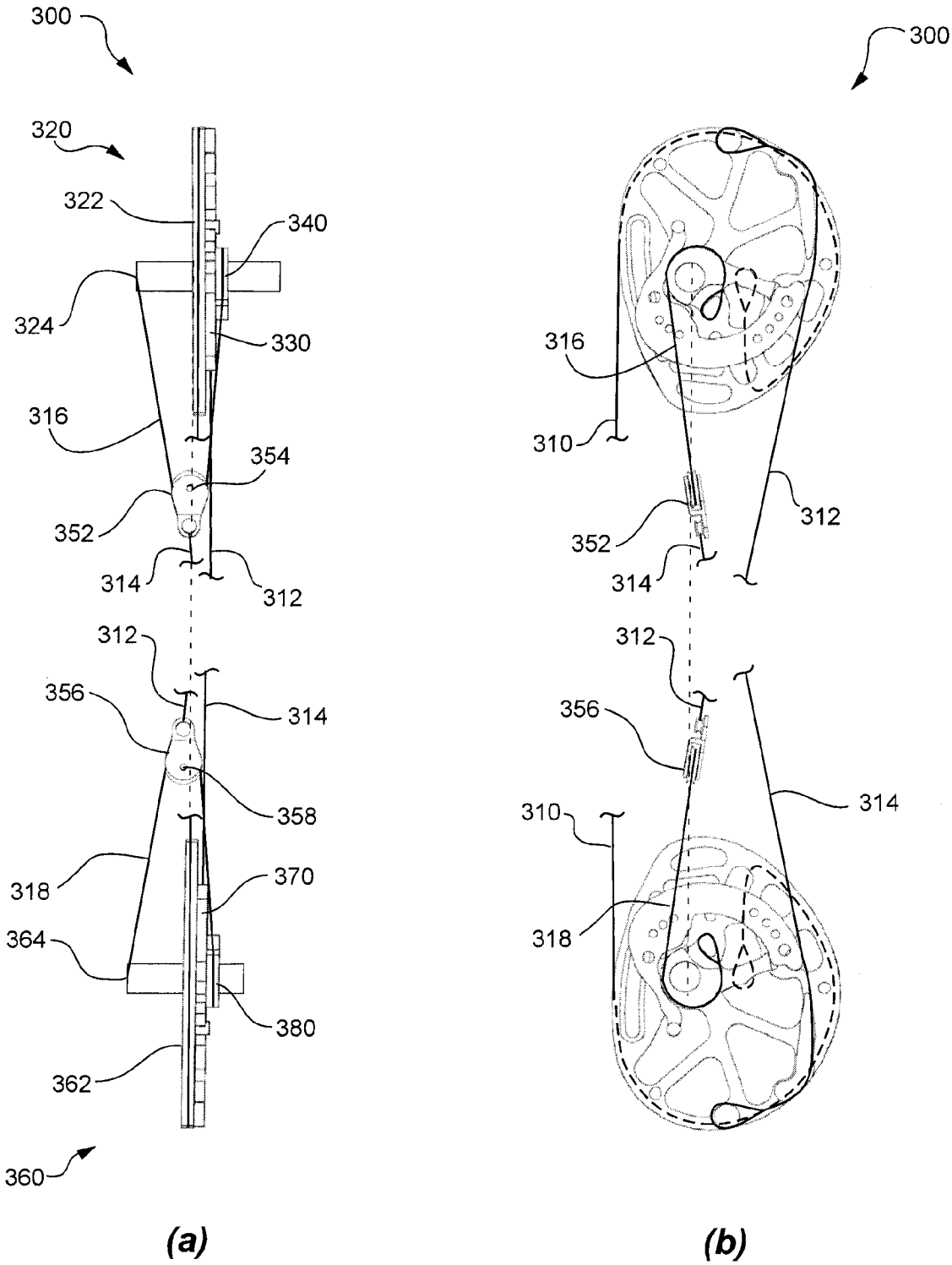
FIGS. 9*a* and 9*b* together illustrate back and side views, respectively, of the upper and lower cam assemblies in an undrawn position, and in accordance with the embodiment of FIG. 8.
Figure 10:
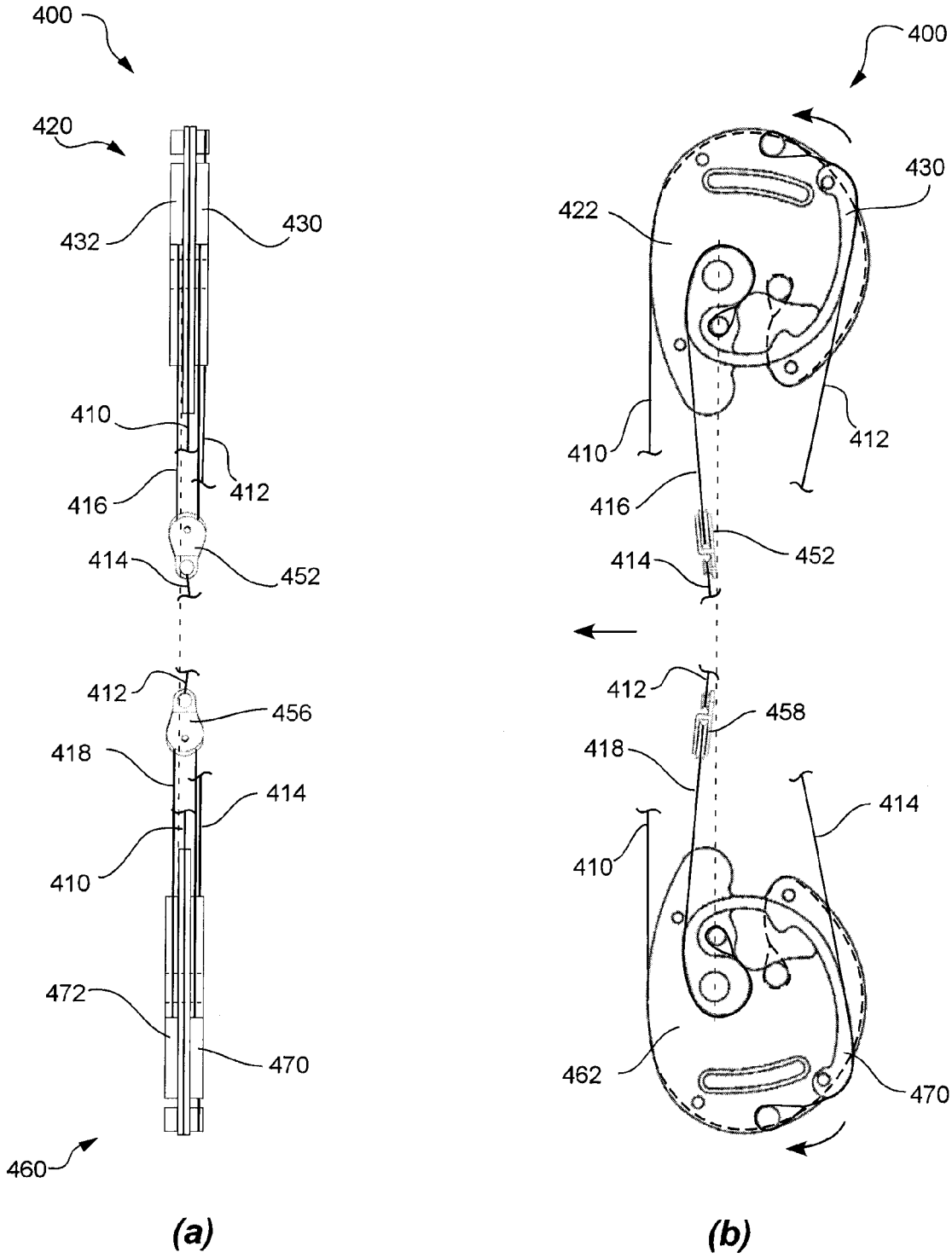
FIGS. 10*a* and 10*b* together illustrate back and side views, respectively, of the upper and lower cam assemblies in an undrawn position, and in accordance with yet another exemplary embodiment of the present invention.

For example, the upper cam assembly 220 illustrated in FIGS. 6*a* and 6*b* can include a bowstring pulley 222 having an axis of rotation 224 and a bowstring track or journal 226 with a bowstring anchor 228 about which the upper end of the bowstring 210 is looped or attached. The lower cam assembly 260 also has a bowstring pulley 262. The bowstring pulleys 222, 262 operate in a manner similar to the bowstring pulleys described above, in that each bowstring pulley functions as a let-out cam as the bowstring is drawn back by the user, causing the upper cam assembly 220 to rotate counter-clockwise simultaneous with the clockwise rotation of lower cam assembly 260.

Attached to one side of the upper bowstring pulley 222 can be a power cord take-up module 230 having a first power cord take-up track 232 and an anchor 234 about which the upper end of the first power cord 212 can be looped or anchored. Attached to the same side of the upper bowstring pulley can also be a power cord let-out module 250 having a second power cord let-out track 252 and an anchor 254 about which the upper end of the second power cord 214 can be looped or anchored. Both the take-up module 230 and the let-out module 250 can be substantially planar cam bodies having separate, single-purpose power cord journals or tracks formed in the edge surfaces, resulting in an upper cam assembly having three tracks 226, 232, 252. However, the take-up and let-out cam modules can both be positioned against the same face of the bowstring pulley and nested within each other so that the first and second power cords continue to share a common vertical plane 204. (see FIG. 7*a*).

The lower cam assembly 260 can also have separate take-up 270 and let-out 290 modules have separate, single-purpose power cord journals or tracks 272, 292 formed in the edge surfaces, resulting in a lower cam assembly having three tracks 266, 272, 292. As a result, the exemplary embodiment 200 of the cam assembly sub-system shown in FIGS. 6*a*, 6*b*, 7*a* and 7*b* can be described as a two plane/three-track (202, 204) system in which both the first and second power cords still share a common plane, providing many of the same advantageous performance as described above.

The embodiment 200 of the cam assembly sub-system can be further advantageous by allowing for separate adjustment of either or both of the take-up 230, 270 and let-out 250, 290 power cord cam modules mounted to the sides of the bowstring pulleys 220, 260. For instance, in the embodiment 200 the position of the take-up cam modules 230, 270, relative to the body of the bowstring pulley can be adjustable. Both take-up cam modules can include a pin 240, 280 anchoring one end of the module, and which can slide within a slot 242, 282 formed in the body of the respective bowstring pulley (see FIG. 7*b*). The other ends of the take-up cam modules 230, 270 can include a set screw 244, 284 inserted into one of several positioning holes 246, 286 formed in the body of the take-up cam module and fastened into a threaded mounting hole (248, 288), also formed in the body of the respective bowstring pulley. Removing the set screws from the mounting holes allows the take-up cam modules to be re-positioned at pre-defined increments, which in turn adjusts the draw length of the cam assembly sub-system, etc. The take-up cam modules can then be re-attached to the bowstring pulleys by installing the set screws using a different positioning hole.

It is to be appreciated that the let-out cam modules could also be adjustable using a sliding pin and set-screw configuration. In another aspect of the present invention, either or both of the take-up 230, 270 and let-out 250, 290 cam modules can be removably attached to the bowstring pulley, and can be replaced with a take-up or let-out cam modules having a different size or shape. In yet another aspect of the present invention, all of the take-up 230, 270 and let-out 250, 290 cam modules can be integrally formed or permanently affixed to their respective bowstring pulleys.

Illustrated in FIGS. 8*a*-10*b* is another exemplary embodiment 300 of the cam assembly sub-system of the present invention, in which one or more ends of a power cord, instead of being directly coupled to a power cord cam module, can be coupled to a rotator splitter. The rotator splitter, in turn, can be operably connected to the mid-section of a splitter cord which has an outside end coupled to a cam module and an inside end coupled either to the free end of the associated flexible limb, or to another cam module on the opposite side of the bowstring pulley. The rotator splitter can function to further balance the torsional forces acting across the cam assembly.

Referring now to FIGS. 8*a*, 8*b*, 9*a* and 9*b*, the cam assembly sub-system 300 can include an upper cam assembly 320 and a lower cam assembly 360, as well as the bowstring 310, a first power cord 312, a second power cord 314, an upper splitter cord 316 and a lower splitter cord 318, in addition to an upper rotator splitter 352 and a lower rotator splitter 356. In the embodiment shown, the upper and lower rotator splitters 352, 356 are coupled to the let-out ends of the second 314 and first 312 power cords, respectively. However, it is to be appreciated that the rotator splitters can be also be coupled to the take-up ends of the first and second power cords and still fall within the scope of the present invention.

With the embodiment 300 of the present invention, the upper cam assembly 320 can be comprised of a bowstring pulley 322, a take-up cam 330 and a let-out cam 340. The let-out cam 340 may be attached directly to the side of the bowstring pulley to form the two-plane/three-track system as described above, or it may be separated axially from the take-up cam to form a three-plane/three-rack system that allows for additional clearance between the upper splitter cord 316 and the upper bowstring pulley 322. The outside end (or right-hand end) of the upper splitter cord may be attached to the let-out cam 340, while the inside end (or left-hand end) may be attached to the far end of the axle 324 supporting the upper cam assembly, or directly to the free end of the upper flexible limb.

In a similar fashion, the lower cam assembly 360 can be comprised of a lower bowstring pulley 362, a take-up cam 370 and a let-out cam 380. The let-out cam 380 may also be separated axially from the take-up cam 370 to allow for additional clearance between the lower splitter cord 318 and the bowstring pulley 362. The outside end (or right-hand end) of the lower splitter cord may be attached to the let-out cam 380, while the inside end (or left-hand end) may be attached to the far end of the axle 364 supporting the lower cam assembly, or directly to the free end of the lower flexible limb.

The upper 352 and lower 356 rotator splitters can act to divide and distribute the load carried by their respective power cords to both sides of the cam assemblies, which can further balance the torsional forces acting across the cam assembly. In one aspect of the present invention the rotator splitter can simply comprise a rounded journal or track along which the splitter cords can slide. In another aspect, however, the rotator splitters can be provided with tracked splitter rollers 354, 358 having internal bearings, to ensure that loads transferred to both ends of the splitter cords are always equal.

Illustrated in FIGS. 10*a* and 10*b* is yet another embodiment 400 of the cam assembly sub-system of the present invention that is similar to the "shoot-through" configuration previously illustrated in FIGS. 5*a* and 5*b*. In this embodiment, dual-purpose power cords cam modules (430, 432 and 470, 472) can be attached to both sides of the bowstring pulley to form both the upper and lower cam assemblies 420, 460. However, instead of using two complete sets of power cords, only a single set of first and second power cords 412, 414 may be used. Furthermore, rotator splitters 452, 456 and splitter cords 416, 418 can couple the let-out ends of the second and first power cords 414, 412 to the let-out tracks formed in their respective dual-purpose power cords cam modules (430, 432 and 470, 472). Again, it is to be appreciated that the rotator splitters can be also couple the take-up ends of the first and second power cords 412, 414 to the take-up tracks formed in their respective dual-purpose power cords cam modules (430, 432 and 470, 472), and still fall within the scope of the present invention.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations (e.g., of aspects across various embodiments), adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed and desired to be secured by Letters Patent is:

1. A compound archery bow comprising:

a compound bow frame comprising a rigid handle section having a rearwardly projecting upper flexible limb and a rearwardly-projecting lower flexible limb;

a bowstring and first and second power cords;

an upper cam assembly rotatably supported at a free end of the upper flexible limb, the upper cam assembly comprising:

an upper bowstring pulley having an upper bowstring let-out track;

a first power cord take-up track; and a second power cord let-out track which does not operate to take up the first power cord;

a lower cam assembly rotatably supported at a free end of the lower flexible limb, the lower cam assembly comprising:

a lower bowstring pulley having a lower bowstring let-out track;

a second power cord take-up track; and a first power cord let-out track which does not operate to take up the second power cord;

the upper bowstring let-out track and the lower bowstring let-out track being aligned in a first bowstring plane; and the first power cord take-up and let-out track and the second power cord take-up and let-out track being aligned in a second plane.

2. The archery bow of claim 1, wherein:

each power cord take-up track further comprises a take-up cam module attached to the upper or lower bowstring pulley, respectively; and each power cord let-out track further comprises a separate let-out cam module attached to the upper or lower bowstring pulley, respectively.

3. The archery bow of claim 2, wherein each take-up cam module is nested between a let-out cam module and an axis of rotation of the upper or lower bowstring pulley, respectively.

4. The archery bow of claim 2, wherein each take-up cam module is removably attached to the upper and lower bowstring pulleys, respectively, for replacement with a take-up cam modules of differing size.

5. The archery bow of claim 2, wherein each take-up cam module is adjustably attached to the upper and lower bowstring pulleys, respectively, to provide adjustment of the draw length of the bowstring.

6. The archery bow of claim 1, wherein each power cord take-up track and let-out track are formed in a edge surface of a planar cam module attached to a side of a bowstring pulley.

7. The archery bow of claim 6, wherein a shape of a cam module is selected from the group of shapes consisting of round, eccentric and non-circular.

8. The archery bow of claim 6, wherein the shape of a cam module on the upper cam assembly is a mirror image of the shape of a corresponding cam module on the lower cam assembly.

9. The archery bow of claim 1, further comprising a guide rod coupled to a guide section of the frame for slidably supporting a power cord harness thereon, wherein the power cord harness separates the first power cord and second power cord into spaced-apart guiding planes to avoid contact between the first power cord and second power cord.

10. The compound archery bow of claim 1, wherein the second power cord let-out track is integral with and fixedly attached to the upper bowstring pulley and the first power cord let-out track is integral with and fixedly attached to the lower cam bowstring pulley.

11. The compound archery bow of claim 1, wherein the bowstring pulley further comprises a draw stop for preventing the cam assembly for overrotating when pulled into a drawn position.

12. The compound archery bow of claim 11, wherein the bowstring pulley further comprises a slot and wherein the draw stop is slidably retained within the slot.

13. The compound archery bow of claim 1, wherein the first power cord take-up track comprises a first portion of a continuous track fixedly attached to the bowstring pulley and the second power cord let-out track comprises a second portion of the continuous track.

14. The compound archery bow of claim 1, wherein the first power cord take-up track does not operate to let out the second power cord and wherein the second power cord take-up track does not operate to let out the first power cord.

15. A compound archery bow comprising:

a compound bow frame comprising a rigid handle section having a rearward-projecting upper flexible limb and a rearward-projecting lower flexible limb;

an upper cam assembly rotatably supported at a free end of the upper flexible limb, the upper cam assembly comprising:

an upper bowstring pulley having a bowstring let-out means;

a first power cord take-up means; and a second power cord let-out means;

a lower cam assembly rotatably supported at a free end of the lower flexible limb, the lower cam assembly comprising:

a lower bowstring pulley having a bowstring let-out means;

a second power cord take-up means; and a first power cord let-out means; and at least one rotator splitter operably connecting a power cord to a mid-section of a splitter cord having an outside end and an inside end, the outside end being coupled to at least one power cord let-out means or take-up means and the inside end being coupled to the free end of the supporting limb.

16. The archery bow of claim 15, wherein the at least one rotator splitter further comprises a rotating roller.

17. The archery bow of claim 15, wherein the upper bowstring let-out means and the lower bowstring let-out means are aligned in a first plane, the first power cord and second power cord take-up means are aligned in a second plane, and the first power cord and second power cord let-out means are aligned in a third plane.

18. A cam assembly for mounting on an axel disposed on a free end of a flexible limb of a compound archery bow comprising a bowstring and first and second power cords such that the cam assembly rotates about the axel when the compound archery bow is drawn to a firing position, the cam assembly comprising:

a bowstring pulley having a bowstring let-out track comprising a first plane;

a first power cord take-up track operable to take up the first power cord when the compound archery bow is drawn to a firing position; and a second power cord let-out track fixedly attached to the bowstring pulley, the second power cord let-out track operable to let out the second power cord when the compound archery bow is drawn to a firing position and not operable to take up the first power cord when the compound archery bow is drawn to a firing position, wherein the first power cord take-up track and the second power cord let-out track are aligned together in a second plane, and wherein the second power cord let-out track is concentric with the axel and an axis of rotation of the cam assembly.

19. The cam assembly of claim 18, wherein the bowstring pulley further comprises a draw stop for preventing the cam assembly for overrotating when the compound archery bow is pulled into a drawn position.

20. The cam assembly of claim 19, wherein the bowstring pulley further comprises a slot and wherein the draw stop is slidably retained within the slot.

21. The cam assembly bow of claim 18, wherein the first power cord take-up track comprises a first portion of a continuous track fixedly attached to the bowstring pulley and the second power cord let-out track comprises a second portion of the continuous track.

22. A compound archery bow comprising:

a compound bow frame comprising a rigid handle section having rearward-projecting upper and lower flexible limbs;

an upper cam assembly rotatably supported at a free end of the upper flexible limb, the first cam assembly comprising an upper bowstring let-out track, a first power cord take-up track, and a second power cord let-out track;

a lower cam assembly rotatably supported at a free end of the lower flexible limb, the lower cam assembly comprising a lower bowstring let-out track, a second power cord take-up track; and a first power cord let-out track; and at least one rotator splitter operably connecting a power cord to a mid-section of a splitter cord having an outside end and an inside end, the outside end being coupled to one of the power cord let-out track or the power cord take-up track.

23. The compound archery bow of claim 22, wherein the upper cam assembly comprises two second power cord let-out tracks and wherein the outside end of the splitter cord is coupled to one of the second power cord let-out tracks and the inside end of the splitter cord is coupled to the other second power cord let-out track.

24. The compound archery bow of claim 22, wherein the upper cam assembly comprises two first power cord take-up tracks and wherein the outside end of the splitter cord is coupled to one of the first power cord take-up tracks and the inside end of the splitter cord is coupled to the other first power cord take-up track.

25. The compound archery bow of claim 22, wherein the lower cam assembly comprises two first power cord let-out tracks and wherein the outside end of the splitter cord is coupled to one of the first power cord let-out tracks and the inside end of the splitter cord is coupled to the other first power cord let-out track.

26. The compound archery bow of claim 22, wherein the lower cam assembly comprises two second power cord take-up tracks and wherein the outside end of the splitter cord is coupled to one of the second power cord take-up tracks and the inside end of the splitter cord is coupled to the other second power cord take-up track.

* * * * *